US008184995B2

(12) United States Patent
Soures et al.

(10) Patent No.: US 8,184,995 B2
(45) Date of Patent: May 22, 2012

(54) CUSTOMER PART REPLACEMENT FEATURE UTILIZING HIGH FREQUENCY SERVICE INTERVAL FAULT AND SIGNATURE ANALYSES

(75) Inventors: Michael Nicholas Soures, Webster, NY (US); James Joseph Petery, Webster, NY (US); Timothy D. Thomas, Fairport, NY (US); Jeffrey Gramowski, North Chili, NY (US); Cheryl Marie Koenig, Ontario, NY (US); Robert Steven Pozniakas, Rochester, NY (US); David R. Kamprath, Webster, NY (US); Stephen F. Randall, West Henrietta, NY (US); Kathleen Spencer, Webster, NY (US); Nitin Shenoy, Webster, NY (US); Joanna Brown, Fairport, NY (US); Christina DiMarco, Rochester, NY (US); Nancy Kelly, Irondequoit, NY (US); Bernard N. Hakac, Webster, NY (US); Cheng-Ning Jong, North Chili, NY (US); Nate Weldon, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 441 days.

(21) Appl. No.: 12/472,593

(22) Filed: May 27, 2009

(65) Prior Publication Data

US 2009/0297174 A1 Dec. 3, 2009

Related U.S. Application Data

(60) Provisional application No. 61/056,644, filed on May 28, 2008.

(51) Int. Cl.
*G03G 15/00* (2006.01)

(52) U.S. Cl. ..... 399/9; 399/14; 399/15; 399/18

(58) Field of Classification Search ..... 399/9, 11, 399/14–18, 24–26, 33, 109–111, 115, 116, 399/122

See application file for complete search history.

(56) References Cited

U.S. PATENT DOCUMENTS

| | | | | |
|---|---|---|---|---|
| 6,377,758 | B1 * | 4/2002 | OuYang et al. | 399/15 |
| 2002/0110380 | A1 * | 8/2002 | McIntyre | 399/15 |
| 2003/0138258 | A1 * | 7/2003 | Hoberock et al. | 399/16 |

* cited by examiner

*Primary Examiner* — David Porta
*Assistant Examiner* — Jessica L Eley
(74) *Attorney, Agent, or Firm* — Fay Sharpe LLP

(57) ABSTRACT

A diagnostic system made part of or for use with a document handling device in which a customer is guided toward performance of at least one comparison means in a diagnostic routine analysis. The comparison means is selected from a group comprising (1) a first comparison comparing a fused print media and an unfused print media for presence of a defect, (2) a second comparison comparing an output print media and at least one image on a screen for a type of defect, and (3) a third comparison comparing a low-charged print media and a no-charged print media for qualities of the defect. The customer enters a selection based on results of the first, the second, or the third comparisons. The diagnostic system can identify a part causing a defect in the print media based on results of the comparisons.

26 Claims, 2 Drawing Sheets

CUSTOMER PART REPLACEMENT FEATURE UTILIZING HIGH FREQUENCY SERVICE INTERVAL FAULT AND SIGNATURE ANALYSES

CROSS REFERENCE TO RELATED PATENTS AND APPLICATIONS

The present application is a non-provisional based on provisional application No. 61/056,644, filed May 28, 2008, and it claims a benefit of that filing date. The disclosure of the '644 application is incorporated herein by reference in its entirety.

BACKGROUND

The present disclosure is directed toward a document handling system or a diagnostics routine for use with a document handling system, which provides customers with routine capabilities to self-service the document handling system when at least one expired or faulty part is identified by the routine as needing replacement.

A multiple-function printer copier machine, i.e., a document printer, copier, scanner, and facsimile (hereinafter "document handling device"), is capable of performing a number of simultaneous tasks initiated at a work station itself and/or routed from a plurality of remote network destinations. A central document handling device shared by at least two network destinations has proven to be an effective asset in work structures that aim (i) to reduce monetary costs associated with setting up individual document handling devices at each network destination, (ii) to conserve space associated with multiple work stations supporting individual document handling devices, and (iii) to save time associated with individual maintenances of a number of document handling devices.

On occasion, however, a central document handling device malfunctions. This malfunction can cause a number of small disadvantages, the greatest of which can be an inconvenience to the customers sharing the document handling device. Namely, the tasks back-up in a print queue until the malfunction is reconciled. Because document handling devices are appreciated for their achieving rapid delivery times for task commands, the back-up foremost causes frustrations to the persons that are unable to easily identify and remedy the malfunction.

In most cases, the foregoing described malfunctions are fault-driven, i.e., they are caused by a part that needs repair or replacement. There is a plurality of consumable parts and products, such as, for example, ink cartridges and paper, etc., that can be replaced by the customers who deliver tasks to the document handling device. The malfunction isn't as immediately remedied, however, in certain instances when an internal part must be repaired or replaced by a visiting technician, in which case the costs associated with decreased productivity and lost time are incurred by the entity utilizing such document handling device.

In some instances, the downturns are not fault-driven; rather, there is noticed a decrease in the quality of images on the print media. Similarly, the quality issue is presented to the provider of the document handling device, who then sends a service technician to the site for purposes of reconciling the image issue. The supplier of the document handling system thus similarly experiences an increase in ongoing maintenance rates ("OGMR") resulting from these visits. Namely, the supplier incurs losses as a result of unscheduled maintenance visits. Generally, a document handling device is provided with a support system that provides comprehensive live support to a customer when it malfunctions. This support system includes on-call and on-line interactive customer support as well as dispatched on-site service engineers. These engineers are certified, skilled professionals who manage service calls through use of a portable workstation.

The call response for service technicians is prompt; however, there still exists a period of downtime which slows production at the work facility. In certain instances, a customer of a document handling device can tinker with the system if a source of the malfunction is easily identifiable and/or accessible, such as, for example, a print media jam in the print media path. Existing document handling devices oftentimes include step-by-step, illustrated instructions directed toward how a customer can overcome such a jam. There are other instances, however, which specifically require presence of a certified service engineer at the work station, one whom is particularly skilled in identification of and solution of the malfunction. One example of such an instance is for part replacements. Service technicians are specially trained in removal of expired, faulty, and irreparable parts for replacement of new parts. The certified service engineer replaces and repairs parts when servicing of the document handling device presents safety hazards. Generally, the customers using the document handling system are not capable of performing the same service since they acquired no formal, comprehensive knowledge on the device anatomy.

One possible solution to reduce unnecessary downtime resulting from malfunctions caused by expired parts is to provide a document handling system which is capable of instructing a customer through a part replacement procedure after it diagnoses which part is causing a decrease in image quality.

BRIEF DESCRIPTION

The present disclosure is directed toward a document handling system or a diagnostics routine for use with a document handling system, which is capable of diagnosing a part that is compromising image quality. The disclosure further provides customers with a capability to self-service the document handling system when the identified part needs replacement.

A first exemplary embodiment of the present disclosure is directed toward a diagnostic system for use with a document handling device in which comparison means in a diagnostic routine analysis comprises (1) a first comparison between a fused print media and an unfused print media, (2) a second comparison between an output print media and at least one image on a screen, and (3) a third comparison between a low-charged print media and a no-charged print media. The customer enters a selection based on results of the first, the second, or the third comparisons. Results of the first comparison determine if the defect is isolated to the fusing system or xerographics. If necessary, results of the second comparison determine the type of the xerographic defect. Results of the third comparison determine the qualities of the defect. The diagnostic system can identify a part causing a defect in the print media based on results of the comparisons.

A second exemplary embodiment of the present disclosure is directed toward a parts analysis program for use in a document handling device diagnostics system. The parts replacement program comprises at least three routines: (1) a first routine capability based on comparison of a fused print media against an unfused print media; (2) a second routine capability based on comparison of output media against at least one screen image; and, (3) a third routine capability based on comparison of a low-charged print media against a no-charge print media. The parts analysis program furthermore comprises a user instruction capability for a user to replace an identified part. A part needing replacement is identified based on comparison results of the first, the second, and/or the third routines. A replacement procedure is provided to the user based on the identified part needing replacement.

A third exemplary embodiment of the present disclosure is directed toward a method of diagnosing a part needing replacement in a document handling device. The method is achieved by a user performing the following actions: entering a login by a user trained in part replacement procedures; selecting between a first routine, a second routine, and a third routine capability, or a combination thereof; comparing at least one print media with another print media or image; selecting a defect description that best matches the defects identified in the comparison; selecting in a parts library a part identified by the diagnostics system as needing replacement based on the defect selections; and, replacing the part following a user instruction capability providing a replacement procedure.

DETAILED DESCRIPTION

Figure 1:
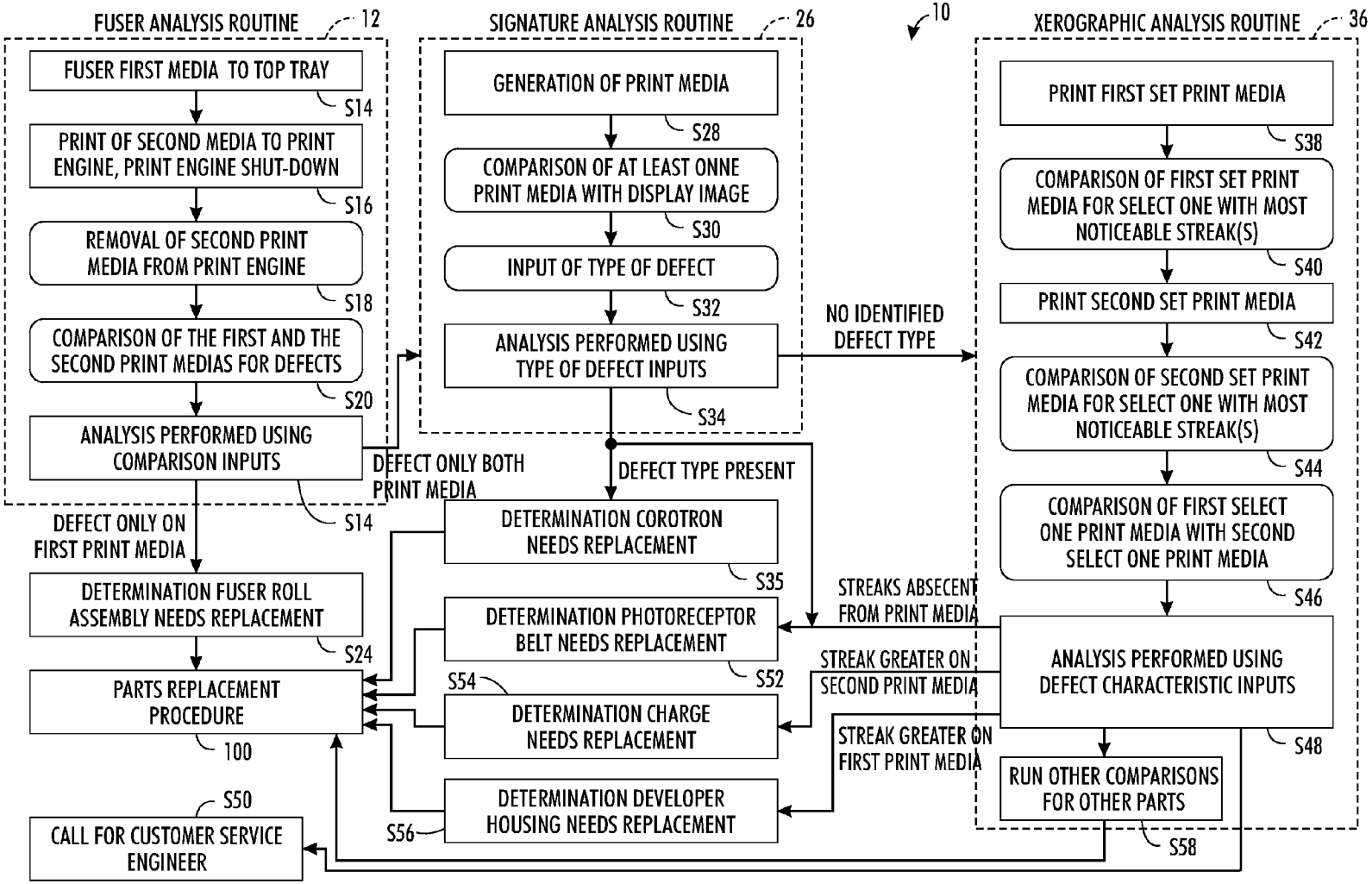
FIG. 1 is a schematic drawing of routine analyses of a diagnostic system according to the disclosure; and, FIG. 2 is a schematic drawing of an existing customer interface including the parts replacement procedure according to the disclosure.

The present disclosure is directed toward a customer part replacement feature for implementation diagnostics of a document handling device. The meaning of the term "customer" as used herein is any person not employed by, or working-for-hire for, a manager, a manufacturer, and/or a distributor (hereinafter collectively referred to as "provider") of the document handling system. A customer can be a person working at, for, with, or unrelated to an entity of which the document handling system is situated. A customer is any person that is not a customer service engineer associated with the provider of the document handling system. Alternatively, customer service engineers are persons commissioned by the provider of the document handling system to service and to maintain the subject document handling device. A customer service engineer is commonly known as an industry, network, and manufacturer-certified professional who can receive continuing training according to technology upgrades and improvements; however, there are no concrete requirements set forth herein for a customer service engineer to be deemed skilled in such service and maintenance.

The term "parts" as used herein refers to, but is not limited to, the following components: any component that causes a downturn to at least one task-related service provided by a document handling device; and, any component that reduces a quality of images placed on print media. A part generally works in conjunction with or works to support functioning of a document handling device. Parts are both internal and external components that can include temporary or permanent placements. Parts can be consumable, integral to, secured to, made part of, or cooperatively operating with the document handling device. Parts can be replaceable, irreplaceable, repairable, or irreparable. The following components are examples of such parts: a transfer corotron, a detack corotron, a pre-transfer corotron, a pre-clean corotron, a charge corotron, a fuser web cassette, a photoreceptor belt, and a fuser roll module assembly, etc.

A document handling system is a multiple task device, in which one faulty part related to performance of only a singular task can obstruct, delay, or preclude performance of any remaining multiple tasks in a queue. In many instances, however, same parts are used to accomplish different, unrelated tasks, so a number of varying task commands cannot be followed or achieved to maximum quality if one multi-functional part expires or malfunctions.

If at least one part hinders performance of the document handling device, it is a relatively standard procedure in existing relationships for a provider of a document handling device to provide all servicing and maintenance means to the customer. An exemplary course followed for a typical malfunction includes a customer contacting a customer support network either interactively, using an on-line service, or telephonically, using a call center. The customer support provider can try to conclude what a source of the malfunction is. Most often, the customer support provider directs a customer service engineer to visit the location of which the document handling system is situated to remedy the problem.

The foregoing provider-customer relationship is described mainly for malfunctions that are fault-driven. However, a system is contemplated herein for instances in which quality of performance of the document handling device is at issue. The present disclosure is directed toward a system and a method that eliminates or reduces the foregoing course required to remedy the document handling device. The present disclosure provides a document handling device, a diagnostic routine for use in a document handling device, a procedure performed by a document handling device, and a method of the same, which enables customers to at least partially self-service and self-maintain the document handling device. Namely, the present disclosure firstly provides a system capable of immediately diagnosing a source causing an image quality issue. The disclosure secondly provides a system capable of receiving maintenance work by a customer. The system further provides instructive means to the customer who is servicing the document handling system. One advantage associated with the present disclosure is that customers can manage the quality of images on print media.

The replacement procedures of the present disclosure is not limited to any one cause initiating such change; rather, the disclosure herein provides a servicing means for customers to replace parts when they are advanced in wear, to replace faulty parts when they cause malfunction, and to replace parts that lessen image quality.

FIG. 1 is a flow-chart that presents the present diagnostic system 10. Although the system 10 is illustrated and described below in the form of a series of acts or events, it will be appreciated that the various routines of the present disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated actions may be required to implement a routine in accordance with the present disclosure, and one or more such acts may be combined. The illustrated system and other systems of the disclosure may be implemented in hardware, software, or combinations thereof, in order to provide the control functionality described herein, and may be employed in any system including but not limited to the above described document handling device, wherein the disclosure is not limited to the specific applications and embodiments illustrated and described herein.

The present disclosure isolates component failures. The present system includes a series of automated actions, some of which can be dependent on a series of customer-performed actions. It is an anticipated feature of the present disclosure that the system can be installed at any account without altering the existing customer workflow. Access to the customer print quality diagnostics and the replacement wizards are limited to customers who receive knowledge and training on parts replacements. There are risks incurred by these customers. Replacement of a part subjects them to all of thermal, electrical, and mechanical hazards. Therefore, a first action that can be required for access to these features includes entry of a trained customer login and password. In this manner, the provider of the document handling device can make assurances that a customer servicing such device is aware of the risks involved. The customer can enter the login and the associated password at his or her remote network destination or at the work-station itself.

The diagnostic system 10 herein includes at least one routine. The diagnostic system 10 runs the routine, which produces print media output of which the customer examines. One particular feature of the present diagnostic system 10 is that it can run at least one routine which stresses the system so that defects become visible which are inconspicuous in normal operation. In one embodiment, proper login of a customer presents an options list for which the customer can select activation of at least one of the available routines. More particularly, the system can provide the customer with an option to run a routine for at least one of a singular or multiple print engines.

In one embodiment, the diagnostics system 10 comprises a fuser analysis routine 12, which determines if a fuser roll module needs replacement. A first fused print media is printed to a finisher top tray (step S14). A second, unfused print media is also printed, but the diagnostics system actuates an automated shut down of the select print engine (step S16). The fused and the unfused print media are generated using the same photoreceptor panel to effectively isolate the fusing system from the xerographics system. However, in one embodiment, different photoreceptor panels can be used depending on the analysis. The unfused print media remains in the print engine area. The routine prompts the customer to remove the unfused print media from the print engine area once the automated processes are complete (step S18). The routine prompts the customer to compare the fused print media with the unfused print media to identify at least one defect (step S20).

To remove the unfused print media from the print engine area, the diagnostics system provides a series of instructions for the customer. These instructions provide a basic sequence of simple actions, including, for example, a directive to open a print engine front door, a directive to carefully remove the unfused print media from a specified area, a directive to lower a lifted latch area, and a directive to secure the front door closed. In one embodiment of the diagnostics system, the routine cannot continue unless the system recognizes the customer actions are completed. For example, a sensor can indicate whether or not print engine doors are open and/or closed. A sensor can indicate whether or not an entire unfused sheet is removed from the print engine area.

It is important to note that the customer does not have to, in some embodiments, perform any independent action to activate a "stop" of the print engine which causes the unfused print media to remain there in that area (step S16). Rather, the diagnostic system 10 is programmed to perform such automated action. However, the diagnostic system 10 can rely on certain actions of a customer to conclude its analysis in the various routines. A routine analysis can include examination output actions, and the diagnostic system 10 can prompt the customer through such actions after it generates output print media. The fuser analysis routine 12 cannot be accomplished in one embodiment without completion of the following customer actions: (1) a customer removes the unfused print media from the print engine area S18; and, (2) a customer compares the unfused print media with the fused print media S20.

The unfused print media removed from the print engine is compared to the fused print media for identification of at least one defect S20. The results of the comparison assist the diagnostics program 10 in identifying a possible part that needs replacement. More specifically, results of the first comparison determine if the defect is isolated to the fusing system or xerographics. The diagnostic system 10 can prompt the customer to input therein a description of the defect identified on the print media. The method of input is not limited to any one form. In one embodiment, the diagnostic system 10 displays at least two options describing possible defects, for which the customer can select the option having a description closest matching the results of the comparison. Suggestive descriptions are included in the following selections: a defect present only on the fused print media; a defect present on both print medias; a selection identifying no presence of defects on either the fused or the unfused print media; and combinations thereof, etc.

Dependent on a presence of at least one defect, the routine performs an analysis based on the input(s); the diagnostic system recognizes the selection for the option entered by the customer and uses it to determine if a certain part needs replacement (step S22). For example, if the customer entered a selection for presence of a defect on the fused print media and no presence for a defect on the unfused print media, then the diagnostic system concludes that the fuser roll module may need replacement (step S24).

If, however, the diagnostic system 10 recognizes the option for a description that identifies presence of the defect on both the unfused and the fused print medias, then the fuser analysis routine concludes and a signature analysis routine 26 can initiate.

In one embodiment, inline full width array sensors can automatically evaluate the fused and the unfused print. In this embodiment, a first inline full width array sensor is situated in a media path before the fusing action is performed and a second inline full width array sensor is situated in the media path after the fusing action is performed. In an embodiment that uses full width array sensors, the logic can be integrated into the system so that customer involvement is minimized for defect isolation. The integrated logic is a fault patterns recognition procedure integrated into the diagnosis system 10 so that the faulty part is automatically identified.

The signature analysis routine 26 is another routine embodiment in the present diagnostic system 10. This signature analysis routine 26 can be run in combination with other routines, or the customer can elect to only run such routine after login. Namely, actuation of the signature analysis routine 26 comprises an automated generation of at least 2 output print media (step S28). The diagnostic system 10 prompts the customer to examine the at least one output print media for presence of any defect(s) (step S30). In one embodiment, at least three output media are generated. In one embodiment, at least ten output media can be generated for purposes of identifying a presence of repetitive defects. The output media samples used for repetitive analysis contain two duplicates from the same photoreceptor panel. These output media are labeled or marked by the print engine accordingly to isolate the defect. If a defect is identified, its type is compared to images on a display. These images can take the form of sample defect types, such as, for example, an image of a solid line defect, an image of a deletion defect, a spot(s) defect, an image of a streaks defect, an image of a repetitive defect, etc.

After the automated generation of output print media is complete S28, the diagnostic system 10 prompts the customer to enter a selection that most closely matches the defect type (step S32). The diagnosis system 10 can display at least two descriptions describing possible defects, for which the customer can select the option closest matching the description. Suggestive descriptions are included in the following, and non-limiting, options: a solid line defect; a deletion defect; a spot(s) defect; a streaks defect; a repetitive defect; no defect; and, a combination thereof. Sample images can accompany the display of descriptive options. The sample images can aid the customer in properly identifying the type of defect present on the print media.

Dependent on a type of the at least one defect present, the diagnostic system recognizes 10 the selection entered and uses it to determine if a certain part needs replacement (step S34). Presence of a certain type of defect causes the diagnostic system to conclude that a corotron or photoreceptor needs replacement (steps S35 and S52). The diagnostics system 10 next actuates a part replacement procedure 100, which will be discussed later herein. If, however, the diagnostic system 10 determines that no recognizable part needs replacement, the diagnostic system actuates a xerographic analysis routine 36.

In one embodiment, an inline full width array sensor can automatically characterize the type of defect on the print media while the print media is in a media path or when the image is developed on the photoreceptor without print media. In an embodiment that uses a full width array sensor, the logic can be integrated into the system so that customer involvement is minimized for defect isolation. The integrated logic is a fault patterns recognition procedure integrated into the diagnosis system 10 so that the faulty part is automatically identified.

The xerographic analysis routine 36 is another routine embodiment in the present diagnostic system, which enables isolation of charge devices, imager, developer, and photoreceptor print quality defects. This xerographic analysis routine 36 can be run in combination with other routines, or the customer can elect to only run such routine after login. Actuation of automation steps of the xerographic analysis routine 36, or any other routine, can be limited to the instances when the customer directly inputs a command to start that specific analysis. For example, the customer can click on an icon that prompts for "start" or "next" action, etc.

The xerographic analysis routine 36 can run with various charge levels and relies on both a series of automated, system actions and a series of customer actions. Actuation of the xerographic analysis routine 36 prompts the diagnostic system 10 to print a first set of at least one print media to a finisher top tray (step S38), wherein the at least one print media is outputted with no-charge applied to the photoreceptor. In the no charge mode, only the developer is on and the developer voltage is pulsed on for various durations and levels. In one embodiment, at least two print media are outputted with no-charge. In one embodiment, at least five print media are outputted with no-charge. In one embodiment, up to five print media are outputted with no-charge. After the xerographic analysis routine 36 generates the automated no-charge output of print media, it prompts the customer to complete a series of customer actions. The xerographic analysis routine instructs the customer to remove the no-charge output of print media from the relevant finisher tray. The xerographic analysis routine next prompts the customer to examine the no-charge print media for streaks, and to select the print media exhibiting the most noticeable streaks (step S40). In one embodiment, the xerographic analysis routine 36 prompts the customer to either note or mark such print media as the no-charge print media so it is not confused with future print media. In another embodiment, the print media can be marked on a first side, by the xerographic engine, and labeled no-charge automatically. Then, the routine 36 can print the diagnostic markings used for analysis on the second side without requiring any customer involvement. The selected no-charge print media is set aside, while the remaining print media in a set can be discarded.

The xerographic analysis routine 36 can next prompt the user to input completion of the customer actions. This input, for example, can be in the form of a click of an icon. In another embodiment, sensors can initiate the next set of automated actions. For example, a sensor can recognize when the no-charge print media is lifted from the finisher tray. The automated steps can continue simultaneous to the customer examination actions.

Actuation of the next set of automated actions of the xerographic analysis routine causes the diagnostic system 10 to print a second set of at least one print media to a finisher top tray (step S42), wherein the at least one print media is outputted with low-charge applied to the photoreceptor. In the low charge mode, the developer voltage is pulsed on for various durations and levels for a specific charge level. In one embodiment, at least two print media are outputted with low-charge. In one embodiment, at least five print media are outputted with low-charge. In one embodiment, up to five print media are outputted with low-charge. After the xerographic analysis routine generates the automated low-charge output of print media, it prompts the customer to complete a series of customer actions. The xerographic analysis routine 36 instructs the customer to remove the low-charge output of print media from the relevant finisher tray. The xerographic analysis routine next prompts the customer to examine the low-charge print media for streaks, and to select the print media exhibiting the most noticeable streaks (step S44). Similar to the first set of print media, the xerographic analysis routine 36 either (i) prompts the customer to either note or mark such print media as the low-charge print media or (ii) marks and labels the print media as low-charged on a first side and prints diagnostic markings used for analysis on a second side such that the low-charge print media is not confused with the no-charge print media. The selected low-charge print media is set aside, while the remaining print media in a set can be discarded.

In one embodiment, an inline full width array sensor can automatically characterize both no-charge and low-charge print media while the print media is in a media path or when the image is developed on the photoreceptor without print media. In an embodiment that uses a full width array sensor, the logic can be integrated into the system so that customer involvement is minimized for defect isolation. The integrated logic is a fault patterns recognition procedure integrated into the diagnosis system 10 so that the faulty part is automatically identified.

However, for the former embodiment utilizing customer actions, the xerographic analysis routine 36 next prompts the customer to take the two print medias chosen as the no-charge and the low-charge print medias including the most noticeable streaks. The xerographic analysis routine 36 prompts the customer to compare the two print medias against one another (step S46). The customer is more specifically comparing characteristics of the streaks on the two print medias.

The diagnosis system 10 can display at least two descriptions describing comparative characteristics-results, for which the customer can select the option closest matching the description. Suggestive descriptions are included in the following, and non-limiting, options: a relationship to the number of streaks present on the no-charge print media compared to the number of streaks present on the low-charge print media; the severity of the streaks present on the no-charge print media compared to the streaks on the low-charge print media; the boldness and faintness of the streaks on the no-charge print media compared to the streaks on the low-charge print media; the location of streaks on the no-charge print media compared to the location of streaks on low-charge print media; a combination thereof; and, a lack of a presence of streaks on either the no-charge or the low-charge print media.

Dependent on a quality and characteristic of at least one streak defect present, the diagnostic system 10 recognizes the selection entered and uses it to determine if a certain part needs replacement 48. Dependent on the characteristics of streaks on both the no-charge print media and the low-charge print media, the diagnostics can cause the xerographic analysis routine to conclude that there is no recognizable part in the parts library which needs replacement, in which case the xerographic analysis routine can prompt the customer to call the provider for service by a customer service engineer (step S50). However, a presence and quality of streaks on either the no-charge media or the low-charge print media can cause the xerographic analysis routine to conclude that there is a recognized part needing replacement. If the xerographic analysis determines, based on the customer's inputs, that a streak defect is absent from both the no-charge and the low-charge print media, the diagnostic system can conclude that the photoreceptor belt needs replacement (step S52). If the xerographic analysis determines, based on the customer's inputs, that the defect is more present on the low-charge print media verses the no-charge print media, the diagnostic system can conclude that the charge device needs replacement, and it will display such conclusion to the customer (step S54).

If, however, the xerographic analysis determines that the defect is more present on the no-charge print media verses the low-charge print media, the diagnostic system can conclude that the developer housing needs replacement, and it can display such to the customer (step S56). If streaks are absent from both the first and the second print media, the xerographic analysis determines that the photoreceptor belt needs replacement (step S32). If a recognizable part needs replacement, the diagnostic system 10 initiates a customer self-service replacement procedure 100.

Figure 2:
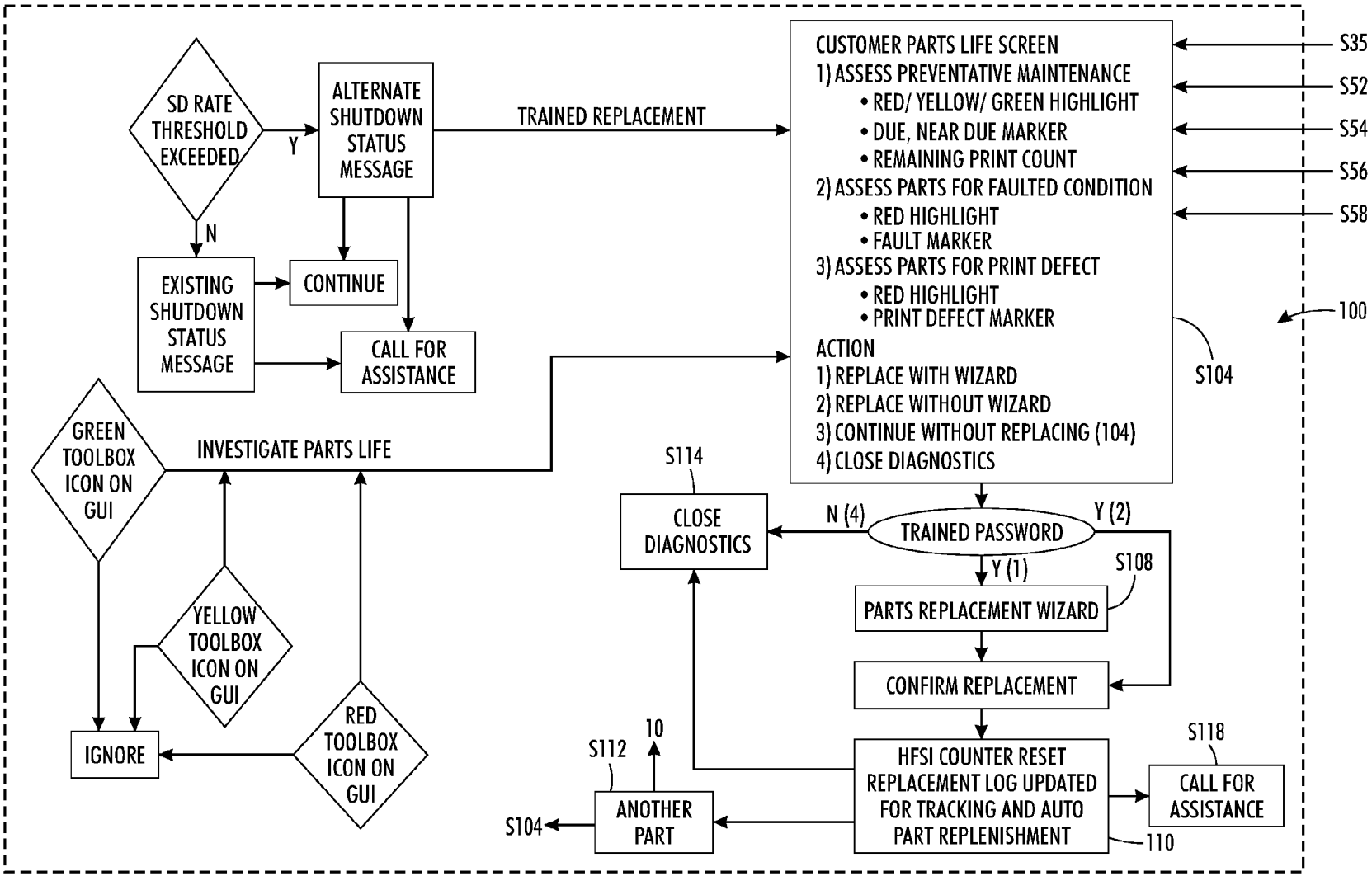

A customer replacement procedure 100 is schematically shown in FIG. 2. Upon login, the customer can elect for immediate actuation of a customer replacement procedure without completing at least one routine. One example when this immediate actuation is likely elected is when a life of a part is known to possibly be past expiration, such as, for example, after n-thousand device tasks are complete. Alternatively, the parts replacement procedure 100 is activated by a conclusion of any one of the foregoing routines that determined if a part needs replacement.

The customer replacement procedure 100 presents one small color coded icon (for all replaceable items) at the highest level of the Graphical User Interface to identify when a part should be ordered and when it could be replaced. No special messages, statuses or pop-ups are displayed for an End Of Life (EOL) condition in order to avoid altering the work flow of the customer. This icon can be ignored by the customer. In order to determine the status of the replaceable items, the operator needs to access the Customer Parts Life screen 104. The Customer Parts Life screen is a listing or library (synonymously referred herein as "window"), i.e., a log, or display of the customer replaceable items and their status. An identifier defines a status of each part in the part library. For example, in one embodiment faulted parts needing replacement are highlighted in a first color while parts not needing replacement are either not highlighted or highlighted in a second color. If any routine 12, 26, 36 concluded that a part needs replacement, that part is automatically identified as needing such by the status identifier. In another embodiment, a part can simply be identified as needing replacement if its life is known to be past known expirations. The customer can select the part to be replaced from the overall parts library (step S104), which provides a capability for preventative maintenance of other parts to optimize. Note that the customer life (remaining prints) associated with a replacement part can be a different value than that seen by the service engineer since the value for the service engineer is optimized to avoid any unscheduled maintenance while the customer thresholds are optimized to prevent print defect thresholds.

The customer replacement procedure 100 recognizes the status of a customer selected part or patterns associated with the status of a part, and it presents the customer with options to (i) continue to operate the document handling device with the faulty part; (ii) if trained, initiate self-service on the document handling device to replace the part, or (iii) wait for a visit from a customer service engineer to replace the part. The key is that the workflow for the customer is not altered so either a trained or untrained customer can interface with the system. If the customer inputs a selection for self service, the parts customer replacement procedure 100 takes the customer to step S104 where the specific part in question is highlighted. The customer may cancel or elect to replace the part with or without the part replacement wizard, which contains a series of customer instructions specific to replacement of that part (step S108). In one embodiment, each instruction can be presented on a display, wherein an instruction for the next action in sequence cannot be presented unless the customer inputs confirmation of his or her completion of a last action in sequence.

In one embodiment, each instruction for a customer action can be presented with a still video or a detailed walk-through for that action in replacement of the part (step S108). After the series of customer-instructed actions are complete, the parts replacement procedure prompts the customer to input an entry confirmation that the part is replaced. Upon confirmation, the identifier for the status of the part changes in the parts library to that of a non-faulty part. The parts replacement procedure can reset the counter for the new part (step S110), initialize the diagnostic system 10 so that an analysis is reran to verify that earlier identified defects caused by the faulted part are no longer present and update the replacement log for tracking and automatic parts replenishment. If the replacement of the part successfully overcomes the presence of defects, then the parts replacement procedure can move attention to another part needing replacement (step S112) and/or it can cause a login of the diagnostics system herein to expire (step S114). If, however, the replacement of the part does not successfully overcome presence of the defect, the customer replacement procedure 100 can provide instructions for the customer to call the customer service engineer (step S118).

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A diagnostic system for use with a document handling device in which a comparison means in a diagnostic routine analysis comprises:

a first comparison between a fused print media and an unfused print media, the first comparison determining if at least one defect is isolated to a fusing system or to xerographics;

a second comparison between an output print media and at least one image on a screen, the second comparison determining a type of the defect; and, a third comparison between a low-charged print media and a no-charged print media, the third comparison determining qualities of the defect;

wherein the user enters a selection based on results of the first, the second, or the third comparisons and the diagnostic system can identify an associated part causing a defect in the print media based on the selection, identification of the associated part actuates a part replacement instructions procedure for the user.

2. The diagnostic system of claim 1, wherein a routine for the first comparison utilizes:

a first fused print media printed to a finisher top tray; and, a second, unfused print media from a shutdown print engine area;

the unfused print media removed from the print engine is compared to the fused print media for identification of at least one defect;

wherein the user selects from a list of foreseeable defect options in the diagnostic system a selection based on an appropriate defect description.

3. The diagnostic system of claim 2, wherein the fused and the unfused print media are generated from the same photoreceptor panels.

4. The diagnostic system of claim 2, wherein the fused and the unfused print media are generated from different photoreceptors panels.

5. The diagnostic system of claim 1, wherein the list of defect options for the first comparison includes:

a selection identifying a presence of the defect on the fused print media;

a selection identifying the presence of the defect on both the fused and unfused print medias; and a selection identifying no presence of defects on either the fused or unfused print medias.

6. The diagnostics system of claim 5, wherein the diagnostic system can identify if a fuser roll module needs replacement based on the presence of at least one defect on at least one of the fused and unfused print media.

7. The diagnostic system of claim 1, wherein selection options on the screen for the at least one image includes:

a solid line defect;

a deletion defect;

a spots defect;

a streak defect;

a repetitive defect; and, a combination thereof.

8. The diagnostics system of claim 7, wherein the diagnostic system can identify if a corotron or a photoreceptor needs replacement based on the type of defect appearing on the print media.

9. The diagnostic system of claim 1, wherein a routine for the third comparison utilizes:

a first set of at least two print media printed with no charge applied to a photoreceptor;

a select one of the at least two no charge print media which exhibits most noticeable streaks;

a second set of at least two print media printed with low charge applied to a photoreceptor; and, a select one of the at least two low charge print media which exhibits most noticeable streaks;

streaks of the selected no charge one of the at least two no charge print media are compared to streaks of the selected low charge one of the at least two low charge print media.

10. The diagnostic system of claim 9, wherein the comparison of streaks of the selected no charge one of the at least two no charge media with streaks of the selected low charge one of the at least two low charge media includes:

number of streaks;

severity of streaks location on the print media for which streaks reside; and, a combination thereof.

11. The diagnostic system of claim 10, wherein the routine for the third comparison identifies at least one associated part that needs replacement based on the comparison of streaks.

12. The diagnostic system of claim 1, wherein the user selects the system identified associated part from a parts library for the diagnostic system to provide at least one user-instruction specific to a replacement procedure for that associated part.

13. A parts replacement procedure for use in a document handling device diagnostics system, comprising:

a first routine capability based on comparison of a fused print media against an unfused print media;

a second routine capability based on comparison of output media against at least one screen image;

a third routine capability based on comparison of a low-charged print media against a no-charge print media;

a user instruction capability for user replacement of an identified associated part;

wherein an associated part needing replacement is identified based on comparison results of the first, the second, and the third routines and a user replacement procedure is provided based on the identified associated part needing replacement.

14. The parts replacement procedure of claim 13, wherein at least one replacement procedure can be updated based on a level of user certification.

15. The parts replacement procedure of claim 13, wherein the first routine capability provides selections for a presence of defects in the comparison of the fused print media and the unfused print media, the selections include:

a first selection for presence of at least one defect in the fused print media;

a second selection for presence of at least one defect in the unfused print media;

a third selection for presence of print defects in both the fused and the unfused print media;

a fourth selection for no presence of at least one defect in either the fused and the unfused print media; and, a combination thereof.

16. The parts replacement procedure of claim 13, wherein the second routine capability provides selections for a presence of defects in the output print media, the selections include:

a solid line defect; a deletion defect; a streak defect; a repetitive defect; and a combination thereof.

17. The parts replacement procedure of claim 13, wherein the third routine capability provides selections for a presence of noticeable streaks in either or both the no-charge and the low-charge print medias, the selections are based on comparative number of, severity of, location of, and combinations thereof streaks between the no-charge and the low-charge print medias.

18. The parts replacement procedure of claim 13, wherein at least two inline full width array sensors are situated in a media path to evaluate the fused and the unfused print media in the first routine, a first of the inline full width array sensors is situated in the media path before the fusing operation and a second of the inline full width array sensors is situated in the media path after the fusing operation.

19. The parts replacement procedure of claim 13, wherein an inline full width array sensor is situated in a media path or at a photoreceptor to evaluate print defects in the second routine.

20. The parts replacement procedure of claim 13, wherein an inline full width array sensor is situated in a media path or at a photoreceptor to evaluate streaks in the third routine.

21. The parts replacement procedure of claim 13, further incorporating a fault patterns recognition to automatically identify a faulty part.

22. A method of diagnosing a part needing replacement in a document handling device, comprising:

entering a login by a user trained in part replacement procedures;

selecting between a first routine, a second routine, and a third routine capability;

comparing at least one print media with another print media or image;

selecting a defect description that best matches the defects identified in the comparison;

selecting in a parts library a part identified by the diagnostics system as needing replacement based on the defect selections; and, replacing the part following a user instruction capability providing a replacement procedure.

23. The method of claim 22, wherein a routine for the first comparison includes:

printing a fused print media on a finisher top tray;

printing a second, unfused print media and leaving the second, unfused print media in a shutdown print engine area;

removing the unfused print media from the print engine;

comparing the unfused print media with the fused print media for identification of at least one defect; and, selecting an appropriate defect description from a list of foreseeable defects.

24. The method of claim 23, wherein selection of the defect descriptions for the first comparison includes:

a selection identifying a presence of the defect on the fused print media;

a selection identifying the presence of the defect on both the fused and unfused print medias; and a selection identifying no presence of defects on either the fused or unfused print medias.

25. The method of claim 22, wherein selection options on the screen for the at least one image includes:

a solid line defect;

a deletion defect;

a spots defect;

a streak defect;

a repetitive defect; and, a combination thereof.

26. The method of claim 22, wherein a routine for the third comparison comprises:

printing a first set of at least two print media with no charge applied to a photoreceptor;

removing the first set of at least two no charge print media from a top tray;

selecting one of the at least two no charge print media which exhibits most noticeable streaks;

marking the selected no charge one of the at least two no charge print media;

commanding the document handling system to continue the routine;

printing a second set of at least two print media with low charge applied to a photoreceptor;

removing the second set of at least two low charge print media from a top tray;

selecting one of the at least two low charge print media which exhibits most noticeable streaks;

marking the selected low charge one of the at least two low charge print media; and, comparing streaks of the selected no charge one of the at least two no charge print media with streaks of the selected low charge one of the at least two low charge print media.

* * * * *